United States Patent [19]

Denhart

[11] 4,290,548

[45] Sep. 22, 1981

[54] HIGH SECURITY TAMPER-PROOF MAILBOX

[75] Inventor: Norbert J. Denhart, Cincinnati, Ohio

[73] Assignee: Elm Window Co., Cincinnati, Ohio

[21] Appl. No.: 130,111

[22] Filed: Mar. 13, 1980

[51] Int. Cl.[3] ..... B65D 91/00

[52] U.S. Cl. ..... 232/24; 232/17

[58] Field of Search ..... 232/17, 24, 25, 45

[56] References Cited

U.S. PATENT DOCUMENTS

| | | | |
|---|---|---|---|
| 675,753 | 6/1901 | Myer | 232/23 |
| 1,052,159 | 2/1913 | Martzloff et al. | 232/45 |
| 1,612,335 | 12/1926 | Wilhelm | 232/24 |
| 1,756,945 | 5/1930 | Hammer | 232/24 X |
| 1,762,477 | 6/1930 | Hughes | 232/45 |
| 2,623,689 | 12/1952 | Barlick | 232/25 |
| 3,784,089 | 1/1974 | Koch | 232/24 |
| 4,121,758 | 10/1978 | Bonner | 232/24 X |
| 4,161,274 | 7/1979 | Bishop et al. | 232/24 |

FOREIGN PATENT DOCUMENTS

| | | | |
|---|---|---|---|
| 2247903 | 5/1975 | France | 232/24 |

*Primary Examiner*—Roy D. Frazier
*Assistant Examiner*—Peter A. Aschenbrenner
*Attorney, Agent, or Firm*—Kinney & Schenk

[57] ABSTRACT

A high security mailbox for multiple family dwellings is provided with sliding doors opening to individual compartments. The doors slide in a channel between a one piece face plate and retaining means which are welded to the mailbox housing.

4 Claims, 7 Drawing Figures

HIGH SECURITY TAMPER-PROOF MAILBOX

BACKGROUND

In multiple family dwellings such as apartment buildings, mailboxes are often times located in common or semi-private areas of the buildings. In buildings which do not provide extensive security, mailboxes are often vulnerable to vandalism and theft. The mailboxes are particularly attracted to thieves when they contain money or checks.

Mailboxes for apartment buildings commonly consist of a plurality of compartments set into a wall and covered by a pivotally mounted face plate which covers all of the compartments. When the face plate is opened by pivoting it about its axis, it provides access to all of the mail compartments for distribution by a mailman. In addition, the face plate generally has a plurality of hinged doors with each of the doors corresponding to one compartment of the mailbox. All of the hinged doors, as well as the entire face plate, have locks which are generally operated by keys. The mailman is provided with the key for the entire face plate which is opened by him when delivering mail and each tenant is given a key for his/her own individual and private compartment.

When a thief suspects that a check or money is contained in a mailbox, he/she will frequently attempt to pry the door open through the use of a tool. Entry into the mailbox by use of such a tool is possible because the hinged door either overlaps or abuts the face plate on the side of the door opposite the hinges. The tool is then inserted in such a manner that the face plate serves as a fulcrum for the tool to provide leverage to pry open the mailbox door. Theft of a mailbox contents in the manner described above is a common occurrence in high crime areas of large municipalities.

It is thus a primary aim of the present invention to provide a mailbox which will prevent unauthorized entry.

It is a further object of the present invention to provide a mailbox which has doors to individual compartments which are not hinged.

It is yet another object of the present invention to provide a mailbox with a door which is not easily pried open.

SUMMARY OF THE INVENTION

In accordance with the invention, a security mailbox is provided which includes a housing having top, bottom, side and back walls. A plurality of spaced partition members extend from the back and bottom walls toward the top wall in parallel relationship to the side wall. These partition members serve to divide the housing into a plurality of individual compartments. A face plate in the form of a solid or integral sheet is securely affixed to the housing and is joined to the top, bottom and side walls. This face plate is apertured in correspondency to the individual compartments in such a manner so as to provide an opening into each compartment. The face plate extends beyond the vertical and horizontal limits of the housing. Retaining means are securely fixed to the partitions on each side of the interior compartments and to a partition and a side wall of the outer most compartments. These retaining means are spaced from the base plate by a predetermined distance and cooperate with the base plate to form channels therebetween. Closure members are slidably movable within the channels and these closure members are operative to close the apertures in a first position. The closure members are slidable to a second position which at least partially opens the aperture. Means are also provided for securing the closure members in the first position.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
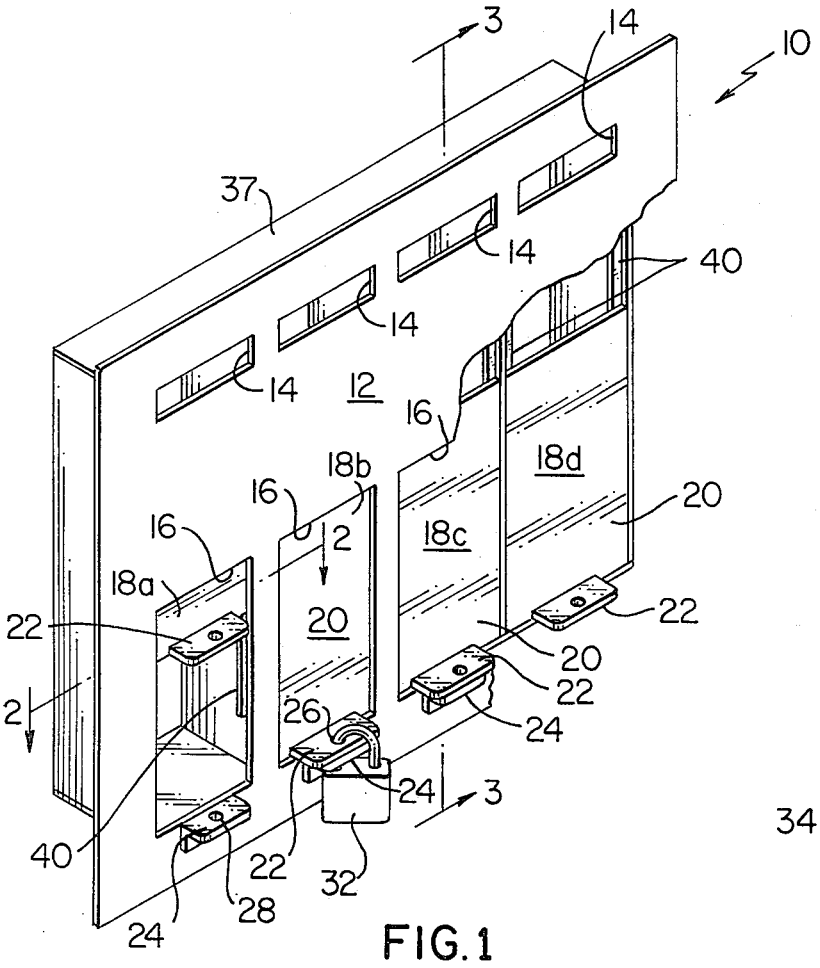
FIG. 1 is an issometric view of a complete mailbox unit with one door in an open position and another door locked in a closed position.

Referring now to the drawings and to FIG. 1 in particular, a multiple compartment mailbox is shown and generally designated by the number 10. The mailbox 10 has a front plate or panel 12 formed of 12 gauge carbon steel. The front panel 12 contains two sets of apertures, 14 and 16.

The second set of apertures 16 are substantially larger than the first set 14 and are generally rectangular in shape. Closure members or doors 18 (the individual doors are designated 18*a*, 18*b*, 18*c*, and 18*d*) are slidably fitted proximal to each of the apertures to close or block the aperture when the doors are in a first position. Each of the doors 18 consist of a main section 20 which is substantially planar in configuration with a retaining flange 22 extending outwardly near the bottom of the main portion 20 in substantially perpendicular relationship to the main section. A mating retaining flange 24 is secured to the front panel 12 immediately beneath each of the large apertures 16. Each of the retaining flanges 24 has an aperture 26 which is in alignment with an aperture 28 in the retaining flanges 24. A padlock 32, shown securing the door 18*b* in a first position, may be inserted through both of the apertures 26 and 28 when the doors are closed to secure the closure member or door 18 in the first position. In the illustration of FIG. 1, doors 18*b*, 18*c*, and 18*d* are depicted in the first or closed position whereas door 18*a* is depicted in an open or second position which opens the aperture 16.

Figure 3:
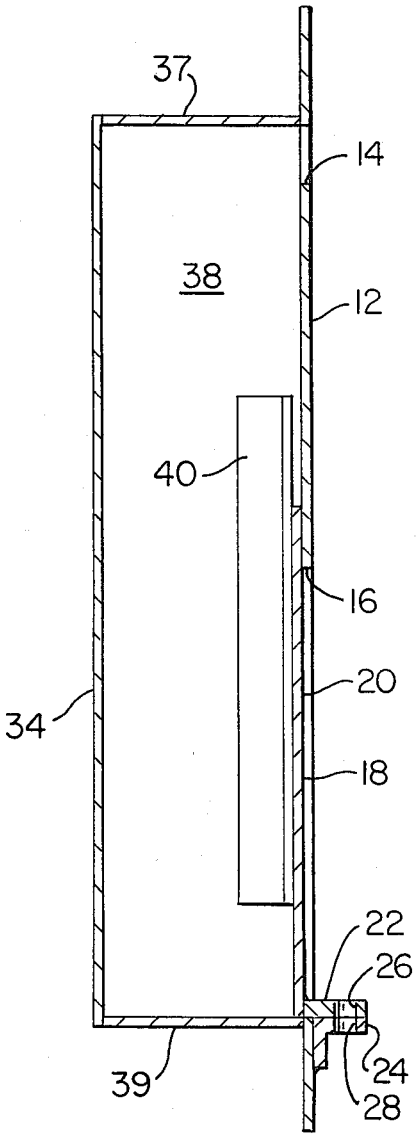
FIG. 3 is an end view, partially in cross section and taken along line 3—3 of FIG. 1.
Figure 2:
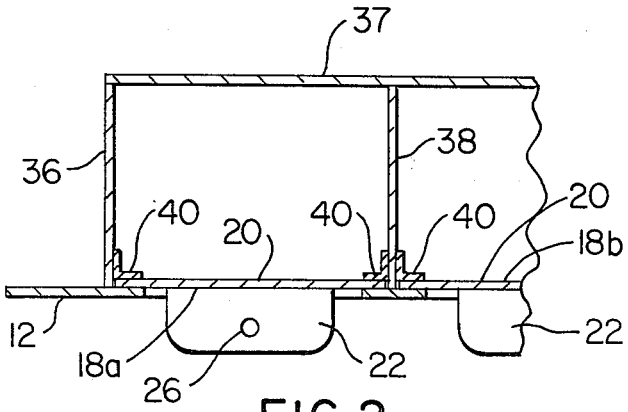
FIG. 2 is a plan view of the mailbox of FIG. 1 taken along line 2—2 which illustrates how channels are formed between a front plate and retaining means secured to the side walls and partition members.

FIGS. 2 and 3 show that the mailbox 10 further includes a back plate 34 joined to the front plate 12 by a top plate 37, a bottom plate 39 and a pair of side walls 36 (only one of which is shown in FIG. 2) and a plurality of partition members 38. The partition members 38, as well as the top plate 37, the bottom plate 39 and the side walls 36 are formed of a 12 gauge carbon steel. The partition members 38 cooperate with the back walls 34, the front plate 12 and the two end walls 36 to form a plurality of compartments between the two end plates 36. As suggested by the illustration of FIG. 2, the partition members 38 are spaced by a predetermined distance so as to correspond with the spacings of the large apertures 16. Thus, each of the apertures 16 opens into a separate compartment which is defined by the top wall 37, bottom wall 39, back wall 34, front plate 12 and the partition members 38.

As seen in FIGS. 1 and 3 but perhaps depicted most clearly in FIG. 2, each of the compartments has a pair of angles 40 which are welded onto the respective end plates and partition members near the corners of the individual compartments adjacent to the large apertures 16. The angles 40 are spaced from the front plate 12 by a predetermined distance slightly in excess of the width of the sliding door or closure member 18. This spacing defines a channel through which the closure member 18 is slidably movable.

In the illustrated embodiment, mail is delivered to the individual compartments by a mailman through the smaller apertures 14 in the face plate 12. FIG. 3 shows that the apertures 14 are disposed above the closure member 18 when the closure member 18 is in the first or closed position as illustrated in FIG. 3.

Figure 4:
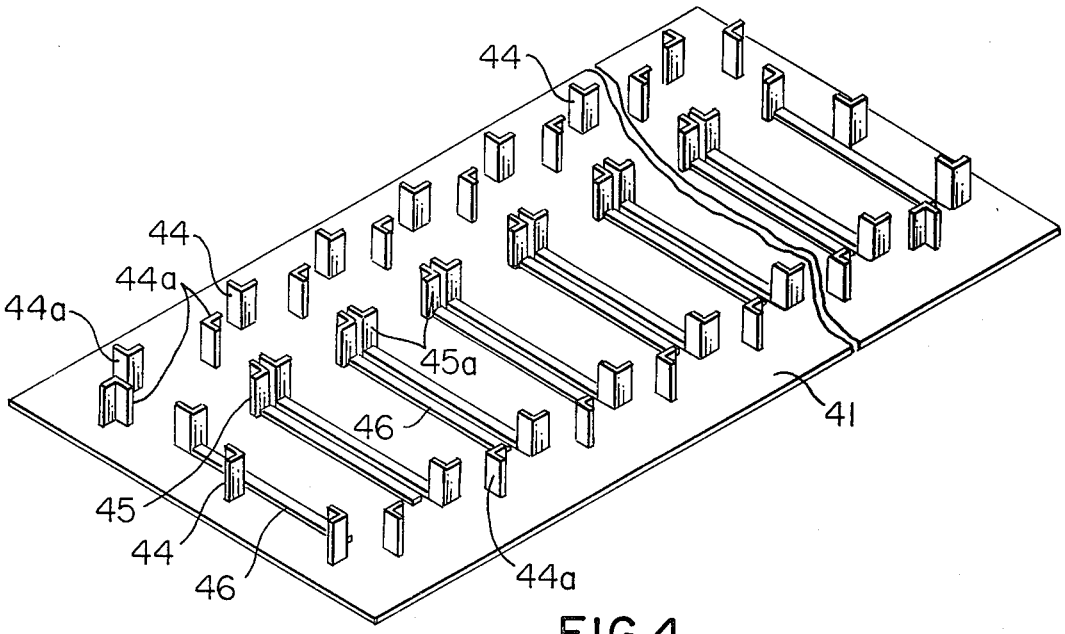
FIG. 4 is a perspective view of a jig for making a mailbox in a high production operation.
Figure 5:
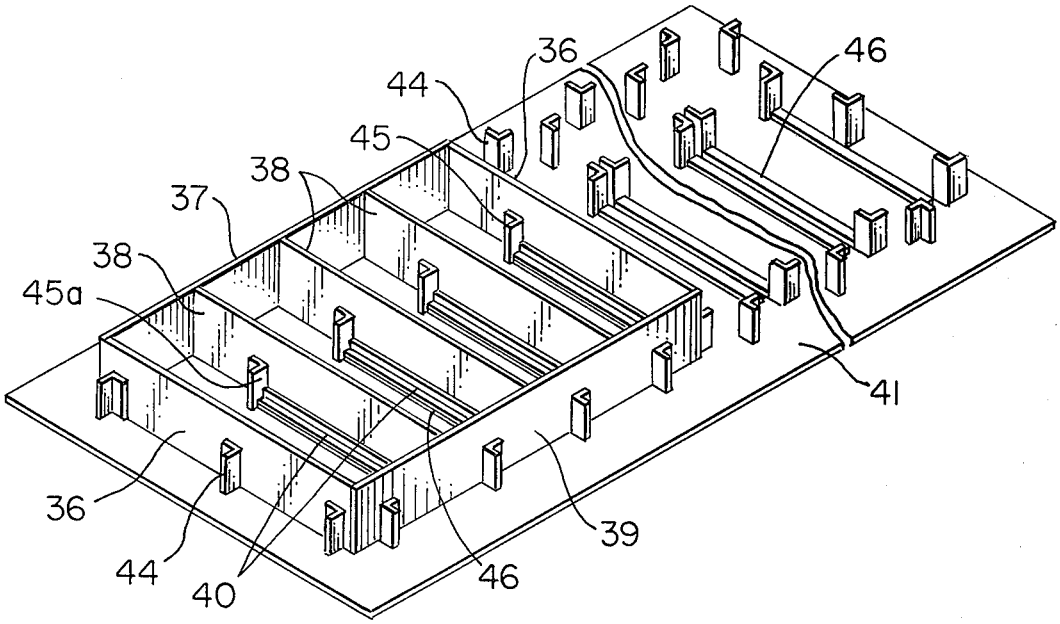
FIG. 5 depicts the jig illustrated in FIG. 4 with the top, bottom and side walls as well as the partition members being fit into position for welding.

FIG. 4 depicts a jig or form upon which the mailbox of FIGS. 1–3 may be constructed. The jig consists of a substantially planar surface 41 with a plurality of guides 44, 45 and spacers 46 extending upwardly therefrom. FIG. 5 illustrates the manner in which the guides 44, 45 and spacers 46 are used. The guides 44 have planar surfaces 44*a* which abut against the respective side (36), top (37) and bottom (39) plates to guide the placement of these members onto planar surface 41. The top (37), bottom (39) and side walls (36) are then placed upon the planar surface 41, the guides 44 serving to hold those members in the placed positions.

The angles 40 are placed upon the spacers 46 and against the respective side walls and partition members. The spacers 46, of course, position the angles 40 on the side walls 36 and partition members 38 and separate the angles 40 from the planar surface 41 by a distance slightly in excess of the width of the closure members 18. When the mailbox is completely constructed, the angles 40 will maintain this same spacing from the face plate 12. In addition, guides 45 are spaced a predetermined distance from the intended location of bottom plate 39. The angle is placed against the guide surface 45*a* of guide 45 to insure this spacing. When the components are held in this location by the respective guides and spacers, the top (37), bottom (39) and side walls (36) as well as the partition members 38 and the angles 40 are all welded together.

Figure 6:
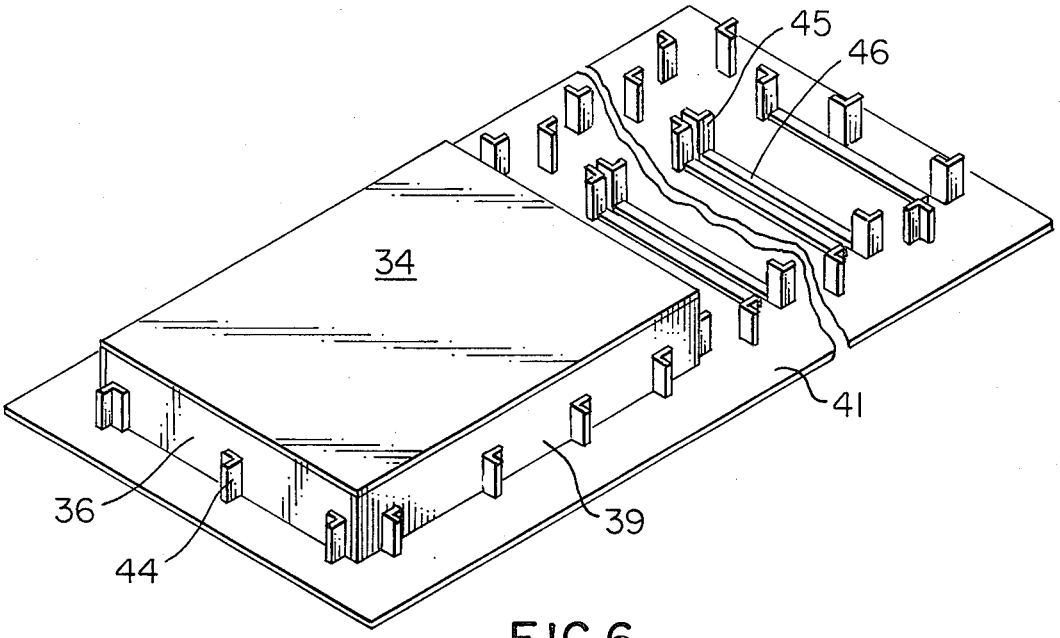
FIG. 6 is a perspective view similar to FIG. 5 but showing the back plate welded onto the top, bottom and side walls.

FIG. 6 depicts the back plate 34 being positioned with respect to the other members. When the back plate 34 is so positioned, it is also welded to the respective top (37), side (36) and bottom plates (39).

Figure 7:
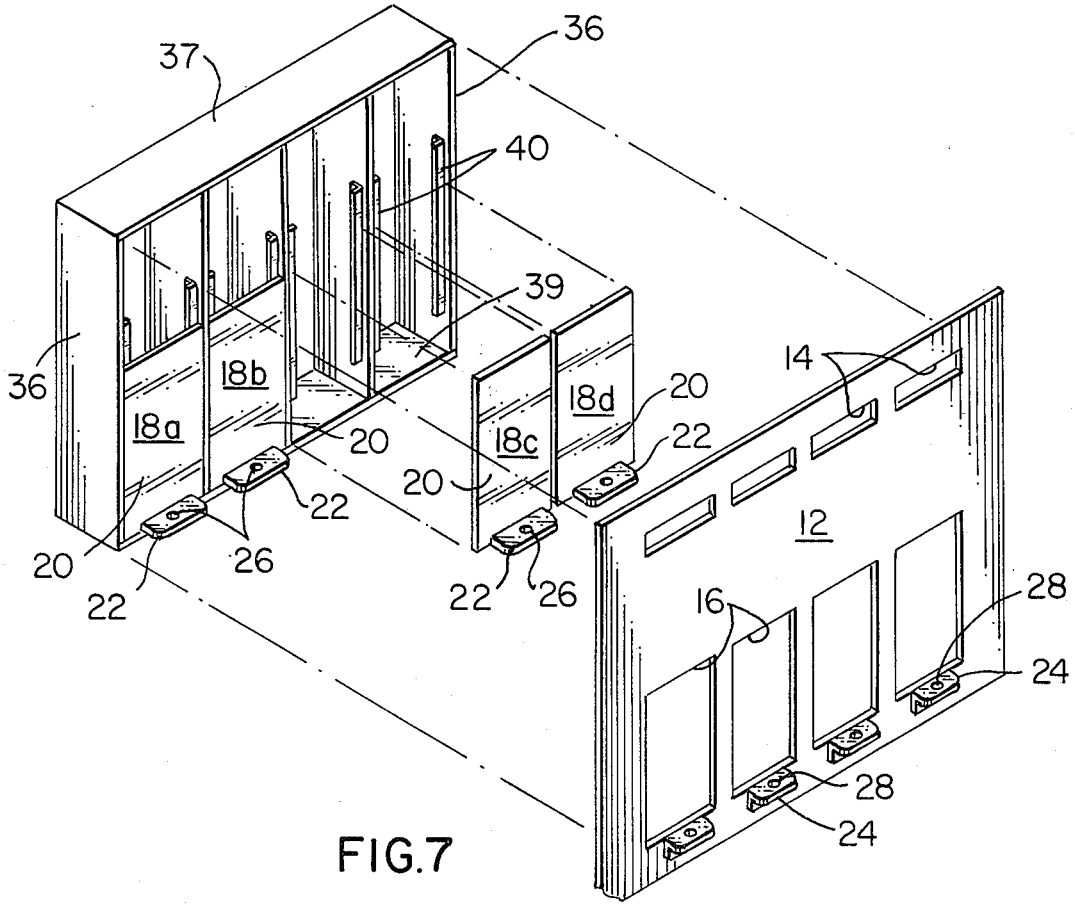
FIG. 7 is an exploded issometric view illustrating the manner in which the closure members are secured in sliding relationship between the retaining means and the front panel.

FIG. 7 illustrates the final stages of construction for the illustrated mailbox. After the welding procedure occurs to secure the back plate 34 as illustrated in FIG. 6, the joined components are removed from the jig and the closure members or doors 18 are placed between the partition members 38 (and the side plates for the outer most compartments) and against the angles 40. The face plate 12, which is formed of a single integral piece of 12 gauge steel, is then placed up against the top (37), side (36) and bottom (39) wall members where it is welded. The portions of the front plate 12 adjacent the apertures 16 thus function to retain the closure members 18 and cooperate with the angles 40 to form a channel therebetween for the sliding movement of the closure members 18.

The embodiment thus far described forms a mailbox which prevents unauthorized entry. The sliding door members 18 are vertically slidable within the channels formed between the front plate 12 and the retaining angles 40. Since these retaining angles 40 are welded to the partition members 38 and the side walls 36, it is most difficult to dislodge the retaining angle members 40. The padlock 32 which secures the doors in the first position makes it virtually impossible to raise the door through which the lock is engaged. If a screw driver or other type of tool were to be inserted into the aperture 16 and against the closure members 18, it is highly improbable that sufficient force could be generated in most circumstances to dislodge the retaining angles 40 from their welded locations.

Thus it is apparent that there has been provided, in accordance with the invention, a mailbox that fully satisfies the objects, aims and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A security mailbox, comprising:

(a) a housing having a top wall, a bottom wall, a back wall and side walls;

(b) a plurality of spaced partition members extending from said back and bottom walls toward said top wall in parallel relationship to said side walls, said partition members dividing said housing into a plurality of compartments;

(c) a face plate in the form of a solid sheet securely affixed to the housing, said face plate being apertured in correspondency to said compartments, the outer edges of the face plate extending beyond the vertical and horizontal limits of the housing;

(d) retaining means securely fixed to the partitions on each side of the interior compartments and to a partition member and a side wall of the outermost compartments, said retaining means being spaced from the face plate by a predetermined distance and cooperating with said face plate to form channels therebetween;

(e) closure members slidably movable within said channels, said closure members being operative to close said apertures in a first position and being slidable to a second position which at least partially opens said apertures; and (f) means for securing said closure member in said first position.

2. A security mailbox as recited in claim 1 wherein said retaining means are welded to said partition members and said side walls.

3. A security mailbox as recited in claim 2 wherein said top wall, said bottom wall, said back, said side walls and said partition members are formed of 12 gauge steel.

4. A security mailbox as recited in claim 1 wherein said securing means includes a retaining flange on the bottom portion of each closure member and a mating flange beneath said apertures on said face plate, said mating flanges having aligned apertures.

* * * * *